United States Patent [19]

Hollo

[11] 4,385,824

[45] May 31, 1983

[54] STATIC DISCHARGE DEVICE

[75] Inventor: Richard B. Hollo, Levittown, Pa.

[73] Assignee: RCA Corporation, New York, N.Y.

[21] Appl. No.: 300,239

[22] Filed: Sep. 8, 1981

[51] Int. Cl.[3] ..... G03G 15/00

[52] U.S. Cl. ..... 355/3 SH; 355/3 R; 355/3 CH; 355/14 SH; 361/212; 361/222; 271/18.1; 271/167

[58] Field of Search ..... 355/3 SH, 14 SH, 14 CH, 355/3 R, 3 CH; 361/212, 222; 271/18, 18.1, 167, 171

[56] References Cited

U.S. PATENT DOCUMENTS

| | | | |
|---|---|---|---|
| 368,315 | 8/1887 | Bathrick | 271/18 X |
| 836,576 | 11/1906 | Wardwicke | 271/18 X |
| 1,120,984 | 12/1914 | Thompson | 361/222 |
| 1,505,349 | 8/1924 | Johnson et al. | 271/167 |
| 2,449,972 | 9/1948 | Beach | 361/212 |
| 2,473,751 | 6/1949 | Johnson | 271/18 |
| 3,260,402 | 7/1966 | Lareau et al. | 271/167 |
| 3,757,164 | 9/1973 | Binkowski | 355/3 CH |
| 3,850,519 | 11/1974 | Weikel, Jr. | 355/3 |
| 3,851,230 | 11/1974 | Okamoto et al. | 361/212 |
| 3,955,811 | 5/1976 | Gibson | 355/14 SH X |
| 4,032,136 | 6/1977 | Komaba et al. | 271/171 |
| 4,060,233 | 11/1977 | Stange et al. | 271/167 |
| 4,132,475 | 1/1979 | Suzuki | 355/3 SH |
| 4,279,504 | 7/1981 | Brown et al. | 355/3 SH X |

OTHER PUBLICATIONS

Catalog AM 2300 Electrostatic Copier Reference Manual, Addressograph-Multigraph Corp., Copyright 1969, pp. 3, 6, 7, 8, 9.

*Primary Examiner*—A. C. Prescott

*Attorney, Agent, or Firm*—Joseph S. Tripoli; Robert L. Troike; William Squire

[57] ABSTRACT

A static charge discharge device for an electrostatic copying machine comprises a set of spaced, bowed, resilient, sheet metal straps which straddle across and engage the uppermost sheet of the stack. The bowed portion of the straps discharge static charges on the uppermost sheet during the feeding of the paper into the corona device.

13 Claims, 6 Drawing Figures

STATIC DISCHARGE DEVICE

The present invention relates to static charge discharge apparatus and, in particular, to devices for conducting to ground static charges appearing on conveyed sheet material.

Some forms of electrostatic copying machines include means for applying a static electrical charge to a zinc oxide coated sheet of paper. The so charged paper translates a light image to which it is exposed to a corresponding charge pattern. The pattern is developed and fixed to produce the final copy.

Such a copying machine may include a paper stacking table on which blank sheets of coated paper are stacked, waiting to be processed by the machine. In one such machine the stacking table moves vertically upward to permit the successive horizontal sheets to be removed from the top of the stack and conveyed to the imaging and developing portions of the machine. Roller devices pull the uppermost sheet from the stack, sliding it through a corona charging device. The table includes vertical guides to keep the edges of the stack straight and vertical and to guide the sheets as they are sequentially slid off the top of the stack.

The machine also includes a sensing device which senses the vertical level of the uppermost sheet of the stack and causes the table to vertically move the upper sheet into its feed position. This permits the machine to continuously pull sheets from the stack in sequence automatically raising the uppermost sheet into its correct feed position.

In one such machine, a roller is placed on the upper sheet adjacent its leading edge. That roller commences the feeding of that uppermost sheet in timed sequence. The sheet is fed to a slanted transfer plate and thence between a pair of feed rollers to between a pair of corona charging devices. In such a machine a continuous problem known as "stream feeding" has been experienced. The term "stream feeding" describes a condition in which the leading edge of a trailing sheet being removed from the stack overlaps the trailing edge of the preceding sheet during the feeding process and which occurs for successive sheets as they are removed from the stack. As a result, the feed rollers over the stack are not effective in controlling the feeding of the individual sheets in the sense that instead of pulling the sheets from the stack in spaced relationship they are pulled from the stack in overlapping relationship.

Another problem experienced with this type of machine is blurring of one or more lines of the image with the remaining copy clear and sharp. This condition has been termed "mechanical" blurring.

The problems discussed above have plagued this type of machine for many years. The manufacturer of one such machine, and others, have come to the conclusion that the stream feeding and blurred image in this type of machine are due to the electrostatic charges on the sheets. As the lead portion of the conveyed sheet becomes contiguous with the corona device, the charge applied by the corona device somehow is transferred to the trailing portion of that sheet. This occurs while the trailing portion of the lead sheet is still overlapping the leading edge of the uppermost sheet of the stack awaiting to be fed into the copying portion. The static charge on that lead sheet is sufficiently great to attract the next adjacent sheet and to pull that next adjacent sheet along with it.

Attempts over the years to solve the stream feeding and blurring problems have been to no avail. Such attempts by the manufacturer of such a machine have included connecting wires to different elements of the machine to electrically connect the elements to system ground to attempt to discharge undesired static charges on the various sheets. One of the elements so connected has been the metal transfer plate which is mechanically connected to the machine frame. The sheet passes over this element before it is engaged by the rollers which are just in front of the corona device. Other attempted solutions have been to apply different materials to that transfer plate in an attempt to enhance its effectiveness as a grounding or static discharging element. A third attempt to solve the problem has been to string metallic foil elements over the path of the fed sheets of paper. The metallic elements resemble somewhat tin foil ropes employed as Christmas tree ornaments. The ropes comprise a wire with tin foil electrodes wrapped around the wire. The electrodes extend in random closely-spaced directions. The ropes are secured horizontally across and parallel to the paper feed path in physical contact with the upwardly facing surface of the sheet of paper as it is being fed.

In accordance with the present invention, in an electrical apparatus including conveyor means for conveying sheet material along a path, means are provided for discharging static charges from the material while it is being conveyed which comprises at least one flexible metal strap coupled to electrical ground. The strap is bowed with the bowed portion in slideable physical contact with the sheet material as the latter moves along its feed path.

Figure 1:
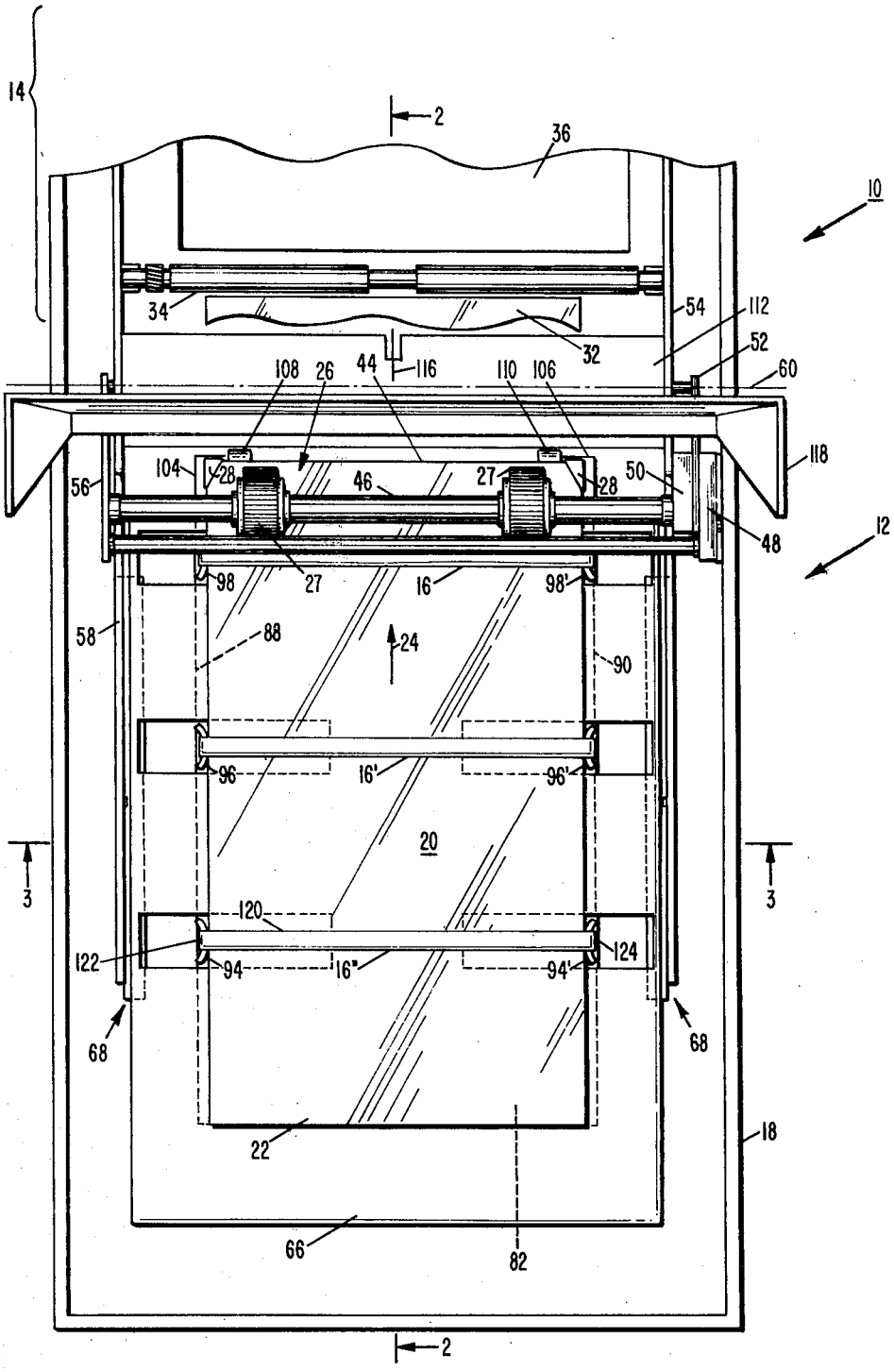
FIG. 1 is a plan view of the stacking and feeding portion of an electrostatic copying machine embodying the present invention.
Figure 2:
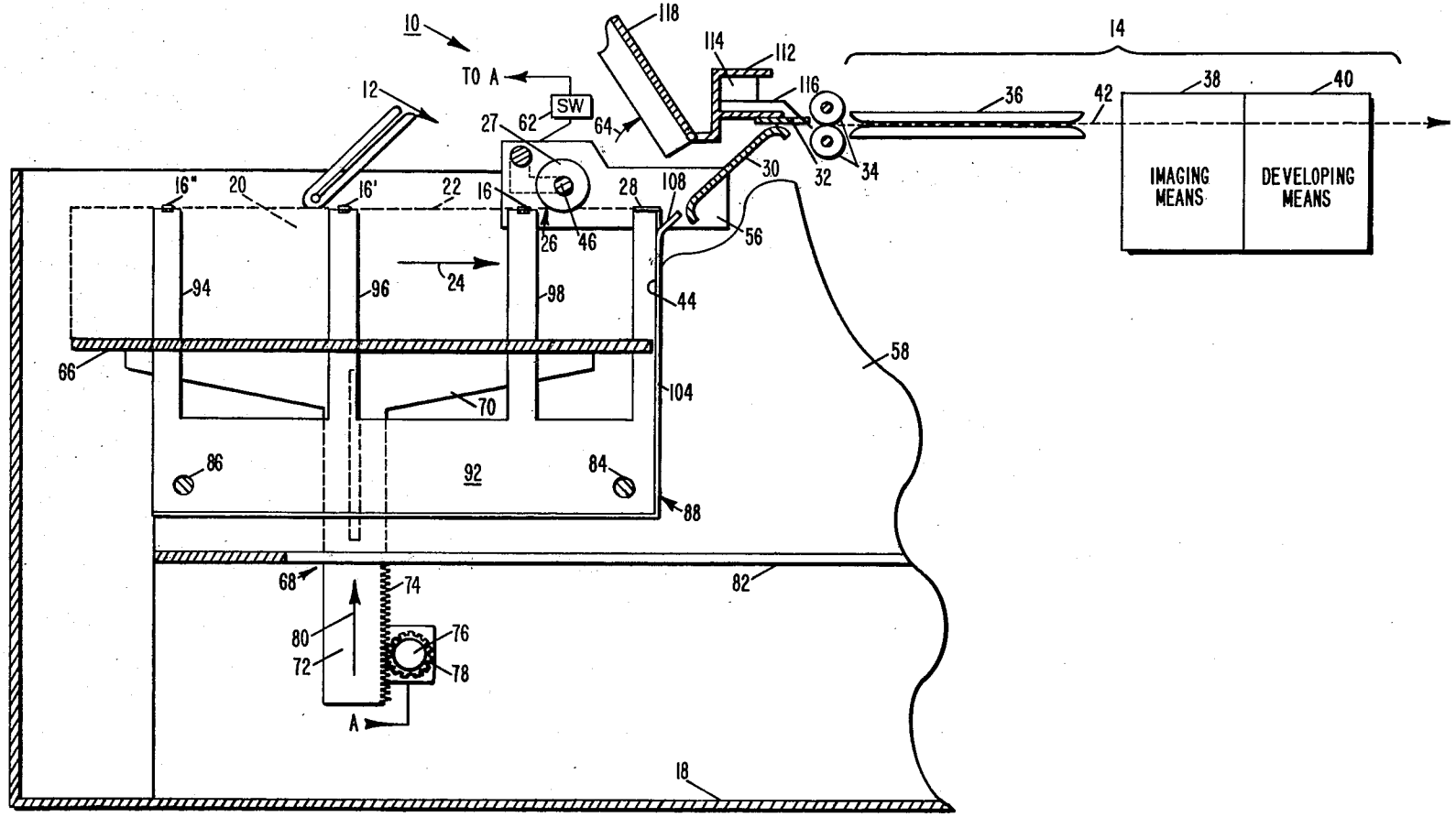
FIG. 2 is a sectional elevation view of the embodiment of FIG. 1 taken along lines 2—2.

Electrostatic copying apparatus 10 of FIGS. 1 and 2 includes a stacking and feeding portion 12 and a copying portion 14. Except for the static charge discharge straps 16, 16', and 16'' of FIGS. 1 and 2, the remaining portions of the apparatus 10 are conventional and are commercially available. While the present invention is described in connection with an electrostatic copying machine, the invention may be employed in other apparatus in which sheet material requiring static charges to be discharged are conveyed in a given path.

Copying apparatus 10 includes a main frame 18. The main frame 18 is a sheet metal box-like structure which serves as a foundation and support for the remaining components of the apparatus and as an electrical ground. Supported in the main frame 18 is stacking and feeding portion 12 which stores a stack 20 of zinc oxide coated paper on which copies of documents are to be made. Each sheet of the stack 20 is of like dimensions and may be of any peripheral dimensions. The uppermost sheet 22 of the stack 20 is fed in the direction 24 by a feed roller 26 under a pair of feet 28 over the surface of a transfer metal plate 30. The sheet is then fed beneath a horizontal metal guide plate 32 and then between a pair of stainless steel rollers 34 and thence into a corona device 36 which applies a static charge to the zinc oxide coated sheet. The sheet continues to be driven by the rollers 34, which are coupled to a drive mechanism (not shown), and by other rollers, through an imaging means 38, which projects an image onto the charged coated sheet to produce a corresponding charge pattern on the sheet. From the imaging means 38 the stack is conveyed to the developing means 40 in which the image is permanently affixed to the paper in a known way. The path of the paper through the corona device 36, imaging means 38, and developing means 40 is shown by the broken line 42.

When conventional $8\frac{1}{2}\times 11$ inch sheets are employed, the length dimension is parallel to direction 24. The length of such a sheet is such that when the leading edge of the sheet being fed through the device 36 reaches the device 36 and is exposed to at least a portion of the charge applying elements of the device 36, a portion of the trailing edge of the fed sheet remains beneath the feet 28 and overlaps a portion of the uppermost sheet 22 at its leading edge 44.

In FIG. 1, roller 26 comprises a pair of rubber cylinders 27 mounted on a drive shaft 46 coupled to a drive motor 48 through a gear box 50. The motor 48 and gear box 50 are mounted on a metal support plate 52 pivotally secured to a metal wall 54. The other end of shaft 46 is secured to metal support plate 56 which is pivoted to metal wall 58. Support plates 52 and 56 are parallel. Walls 54 and 58 are parallel and are secured to frame 18. The pivots of plates 52 and 56 form a pivot axis 60 about which the roller 26 pivots in direction 64, FIG. 2. The roller 26 also rotates about a roller axis formed by the drive shaft 46. The roller 26 is in continuous friction contact with the uppermost sheets due to the force of gravity. In FIG. 2 a micro-switch 62 is coupled to roller 26 to sense the vertical position of the roller. For example, the switch 62 can sense the pivoted position of the plate 56 about the pivot axis 60 (FIG. 1).

Supports 68, FIGS. 1 and 2, each comprise a generally horizontal beam 70 and a vertical pillar 72. Pillar 72 has rack gear teeth 74 formed on one edge thereof. A pinion 76 coupled to teeth 74 is driven by a motor 78. The motor 78 secured to frame 18 is coupled at terminal A to the micro-switch 62 and to a source of power (not shown). Micro-switch 62 opens and closes a circuit (not shown) which applies power to the motor 78. Operation of the motor 78 displaces the pillar 72 vertically in direction 80.

In the operation of the vertical drive of table 66, a stack 20 of paper sheets is placed on the table 66. The roller 26 rests on the upper surface of the top sheet adjacent leading edge 44 of the stack. The switch 62 is open at this point. As the roller 26 is operated by control means (not shown) to feed the uppermost sheets one at a time in the direction 24, the uppermost surface of the stack is lowered by the thickness of a sheet as each sheet is fed into the copying portion 14. As a result, the upper surface of the stack is sequentially lowered. This lowers the roller 26 pivoting roller 26 in a direction opposite direction 64, FIG. 2. At some point when the roller 26 is sufficiently low, the switch 62 closes and causes power to be applied to motor 76. For one particular machine employing 4 mil thick zinc oxide paper the switch 62 is closed to operate the motor 76 after approximately fifteen sheets emptied from the sheath—60 mil variation in vertical displacement of the upper surface of the stack 20.

In FIG. 2, a metal plate 82 is supported horizontally between walls 54 and 58. A pair of horizontal stainless steel rods 84 and 86 are above plate 82 and secured at their respective ends to walls 54 and 58. The rods pass through and are connected to upstanding guide structures 88 and 90 which are mirror images of each other.

Figure 5:
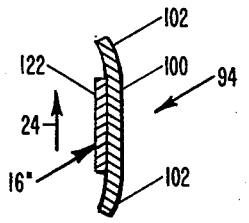
FIG. 5 is a sectional view through a portion of the strap of FIG. 4 secured to the machine of FIG. 1.

The guide structures 88 and 90 (FIG. 1) are stainless steel sheet metal members. Structure 88 and 90 are identical and therefore only one will be described. Structure 88 comprises, in FIG. 2, a base portion 92, and three upstanding paper guides 94, 96, and 98. Diametrically across from the guides 94, 96, and 98 are corresponding paper guides 94', 96', and 98' (FIG. 1) on guide structure 90. The guides, as shown in FIG. 5, such as guide 94, each comprise a central portion 100 which is flat and parallel to direction 24 and two bent edges 102 which are bent away from the stack 20 (FIG. 1).

Adjacent to the leading edge 44 of the stack 20, FIG. 1, are two upstanding posts 104 and 106 formed from and integral with structures 88 and 90, respectively, and which hold the stack 20 in place at the leading edge 44. The feet 28 are secured to the upper edges of the respective posts 104 and 106. The uppermost sheet 22, when fed in direction 24, passes underneath the feet 28. Feet 28 also tend to hold the uppermost sheet in place. In FIG. 1 the upper ends of posts 104 and 106 are bent to form paper guide supports 108, 110. The posts 104, 106, feet 28, supports 108, 110, and guides 94, 96, 98, 94', 96', and 98' are all metal elements and are connected to frame 18 via various metal elements and, therefore, to the machine system ground. The top sheet 22, when fed by roller 26 to the copying portion 14 of the machine (FIG. 2) passes over and is in contact with the metal transfer plate 30. The plate 30 is connected at opposite ends thereof extending in and out of the drawing of FIG. 2 to the respective walls 58 and 54 (FIG. 1). This also connects the plate 30 to system ground.

Guide plate 32, which is metal and may be sheet stainless steel, is secured to a supporting bracket 112 which is connected to the frame 18. A micro-switch 114 mounted to the bracket 112 has a movable probe 116 which contacts the fed sheet of paper as it passes over plate 30 and in contact with and beneath the guide plate 32. Switch 114 senses the presence and absence of a sheet for operating the various portions of the apparatus. The rollers 34 are driven by a suitable drive mechanism connected to a power source for feeding sheet paper between the corona elements of the corona device 36. A cover 118 is hinged to the bracket 112 for covering the stacking portion of the apparatus as shown to the left of the bracket 112. The apparatus described above is conventional and is commercially available.

This apparatus has been in continuous use for many years. While in such use, paper fed from the stack 20 has experienced stream feeding, as defined above, and also blurring, also as described above. Various attempts to connect the various machine elements by wires and by placing additional static charge discharge elements such as a tinsel rope across the upper surface of the upper sheet 22 as it is being fed to the plate 30 did not alleviate the stream feeding and blurring problems.

Figure 4:
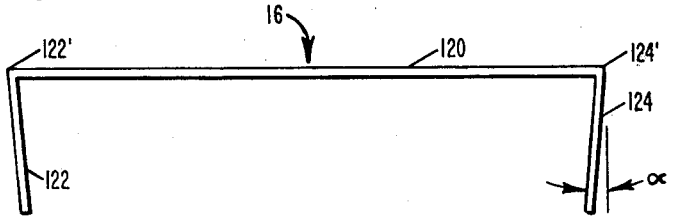
FIG. 4 is a side elevation view of a static discharge strap embodying the present invention.

The above problems were substantially alleviated according to the present invention by the static discharge straps such as strap 16, shown in FIG. 4 not in place in the copying machine. Strap 16, as manufactured, has a base region 120 and two legs 122 and 124 depending from opposite ends of the base region 120. The legs 122 and 124 are bent at the joints 122' and 124', respectively, with the base region 120 forming relatively sharp corners of less than 90°. For example, the radius at the joints 122', 124' may be on the order of 1/16 to ⅛ of an inch for a strap 16 formed of polished stainless steel having a thickness of about 0.020 inch, having a width into the drawing of FIG. 4 about ½ inch. The base region for a machine such as the one described above employing sheets of paper 8½ inches wide, may have a length from joint 122' to joint 124' of about 9 inches. The legs 122 and 124 may be about 2½ inches in length.

As mentioned above, the legs 122 and 124 are at an angle $\alpha$ which is less than 90° with respect to the plane of base 120. With the base horizontal, the legs may be at an angle of say 2°–4° relative to a perpendicular to the base. This angle may vary from this range in accordance with a given implementation. The reason for making angle $\alpha$ less than 90° will become clear from the discussion which follows.

Figure 3:
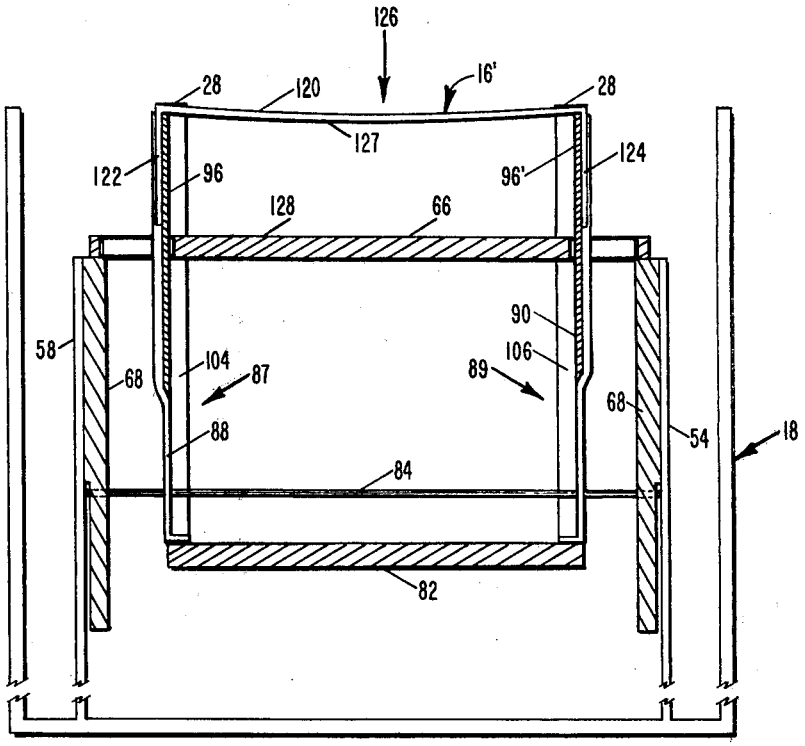
FIG. 3 is a sectional elevation view of the embodiment of FIG. 1 taken along lines 3—3.

The legs 122 and 124 of each strap are slid in place over the upper ends of the respective corresponding guides, for example, guides 94 and 94', FIGS. 1, 2, and 5, strap 16''. The guides 94, 96, 98, 94', 96', and 98' are vertical and parallel to each other. The parallel orientation of the guide pairs 94, 94'; 96, 96'; and 98, 98' displaces the legs 122 and 124 to the vertical orientation. Reference is made to FIG. 3 to show this orientation in connection with strap 16'. The action of making the legs 122 and 124 parallel to each other compressively stresses the base region 120 of the strap, bowing it. The bowing of the strap is in the downward direction 126, FIG. 3, toward table 66 and against the stack 20, FIG. 2. The strap is positioned so that the convex portion of the bow faces resiliently engages the surface of the upper sheet 22 of the stack 20.

The legs 122 and 124 of the straps, such as strap 16', FIG. 3, are in conductive contact with the corresponding guides, such as guides 96, 96'. This provides an electrical path for any static charges removed from the paper to the base region 120, to system ground represented by frame 18, to which guides 94, 94'; 96, 96'; and 98, 98' are coupled. The joints 122', 124', FIG. 3, of the strap 16' abut the upper edges of the guides 96, 96'. In this position, the lower surface 127 of the bowed base region 120 comes into contact with the upper surface of the stack 20. In the absence of the stack, as shown in FIG. 3, the lowermost surface 127 of the convex portion of the bow extends below the position of the upper surface of the stack even with the maximum (60 mil in this example) downward displacement of that upper surface. As can be appreciated, the strap base region 120, due to the bowing configuration is resilient and in operation, remains in continuous physical contact with the upper surface of the uppermost sheet 22 as the sheets 22 are fed into the copying portion 14, FIG. 2 and as that upper surface is vertically displaced downward. To ensure continuous contact with sheet 22 regardless its vertical position, the bow should have a minimum depth in direction 126, FIG. 3, of about 65–70 mils. This value can be different for other implementations.

Figure 6:
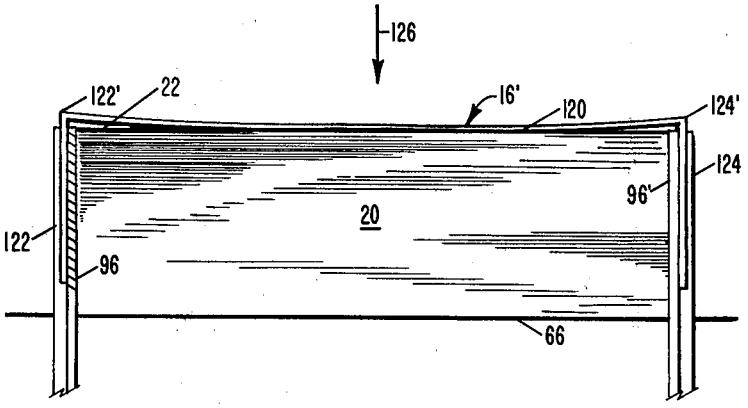
FIG. 6 is an end view of the strap of FIG. 4 as employed with a stack of paper stacked in the machine of FIG. 1.

This is shown more clearly in FIG. 6 in which the stack 20 is shown in place with the bowed base region 120 of the strap 16' in physical contact with the upper surface of the uppermost sheet 22. The uppermost sheet 22 tends to flatten the bow somewhat as it engages the bow and is in contact with the bow over a relatively large portion of the bow, e.g., about 30–50% of region 120. Of course, the actual length of the bow that is in contact with the sheet will vary as the spacing of the uppermost sheet 22 varies within that 60 mil vertical displacement range with respect to the bow's position as discussed above.

The straps 16, 16', and 16'' are substantially identical and are substantially identically secured to the corresponding guides. Strap 16 is slightly rearward of the roller 26 and is adjacent the leading edge 44 of the stack. Strap 16' is midway between the leading and trailing edges of the stack with respect to direction 24. The strap 16'' is adjacent the trailing edge of the stack. As each sheet 22 is pulled from the stack by the roller 26, it is physically engaged by the various straps 16, 16', 16'' at the bowed base regions 120. As the uppermost sheet is fed beneath roller 26 and beneath feet 28, FIG. 2, over plate 30 and between rollers 34, a portion of that sheet is in sliding contact with the straps 16' and 16. At the time the leading portion of that sheet is in the corona device 36, the trailing edge of the sheet is still beneath roller 26 and strap 16. Thus any static charges accumulating on the sheet are conducted to and discharged to system ground by the straps 16, 16', and 16'' during the feeding of the uppermost sheet 22. At all times during the displacement of the upper surface of the sheet 22, the base region 120 of each strap is in good contact with that sheet. The paper supports 108 and 110, FIG. 1, and feet 28, are in contact with the sheet of paper then being fed by the roller 26. Prior to the employing of the straps 16, 16', and 16'', the feet 28 and supports 108, 110, rollers 34, and plate 30 were, for reasons unknown, insufficient to discharge static charges to system ground on sheets of paper that were being fed in contact therewith.

As each sheet of paper is fed, the level of the upper surface of the stack lowers with respect to the position of feet 28 and supports 108, 110. The switch 62 senses the change in level of the stack and when the roller 26 lowers sufficiently, the switch drives the motor 78, operating the pinion 76, raising the pillar 72 in direction 80 to the uppermost level. This displacement, as discussed, is about 60 mils in one implementation. This raising of the table 66 raises the stack 20 and therefore displaces the uppermost sheet 22 this 60 mil displacement. This also flexes the base 120 of the straps 16, 16', and 16''. The bow of the straps is sufficiently great so that any flexing within this displacement range maintains the effective physical contact of the straps with the upper sheet 22 of the sheath. Thus, a flexible strap is provided which maintains good electrical contact with the sheets of paper as they are being fed into the copying portion of the machine regardless the vertical position of the fed sheet with respect to the ground strap. The friction contact of the straps with the respective guides keeps the straps in position as the bowed portion flexes.

What is important is that the strap be bowed and the bowing be sufficiently flexible to permit flexing of the bow when the level of the stack in contact therewith changes. While in the present case the legs of the strap are bent to induce the bowing configuration, the use of legs is not essential. For example, a plane length of strap material may be bowed by squeezing the strap between two spaced members and fixing the ends to those members between points spaced less than the extended length dimension of the strap. Also a plane strap can be bent by clamping its ends to a support at complementary angles to the horizontal to induce the bowing of the strap.

What is claimed is:

1. In an electrical apparatus including conveyor means for conveying sheet material along a path, means for discharging static changes from a surface of said material as it is being conveyed comprising:

a resilient metal strap located over the path, adjacent to the said surface of said sheet, said strap being bowed and being supported relative to the sheet material so that at least a part of the bowed portion of the strap resiliently engages said surface of said material as the sheet material is being conveyed along said path; and means electrically connecting said strap to a point at a potential such that it operates as a drain for static charge.

2. The apparatus of claim 1 wherein said apparatus includes an electrostatic copying machine for applying an electrostatic charge to said sheet material, said machine including means for supporting a stack of sheet paper, means for applying a charge to a sheet of said paper, and means for conveying the uppermost sheet of said stack to said means for applying a charge, and wherein said bowed resilient strap is located adjacent to the top surface of the stack and engages each sheet of paper as it is conveyed from the stack.

3. The apparatus of claim 2 further including paper guide means for holding said stack in place and for guiding said sheets as they are being removed from said stack, said strap being secured to and in conductive contact with said guide means.

4. The apparatus of claim 1 wherein said strap comprises a pair of legs and a base region between the ends of the legs, said base region including said bowed portion.

5. The apparatus as set forth in claim 1 wherein said resilient metal strap extends across said path, generally orthogonal to the direction of travel of the sheet material.

6. The apparatus as set forth in claim 2 wherein said resilient metal strap extends across said path generally orthogonal to the direction of travel of the sheet material, and is located at the leading edge of the stack.

7. In an electrostatic copying apparatus including stacking means for receiving and storing a stack of sheet paper to be fed to the copying portion of said apparatus, means for applying an electrical charge to the uppermost sheet of said stack while each sheet is being removed from the top of the stack and conveyed toward said copying portion, means for projecting an image of an object being copied onto said charged sheet, and means for developing the image on said charged sheet, and wherein each sheet is in surface contact with the preceding sheet in the stack as it is being removed from the stack, the improvement comprising:

at least one bowed spring metal conductor engaged with the uppermost sheet of the stack at the bowed portion thereof as that sheet is being removed from the stack, the convex portion of the bow facing and touching said sheet urging it against said stack, whereby said uppermost sheet being removed from the stack is in contact with said bowed portion as the sheet moves; and means electrically connecting said bowed conductor to ground.

8. The apparatus of claim 7 wherein said conductor is a stainless steel strap bent in the form of an element having a pair of legs and a base between the ends of the legs, said base including said bowed portion.

9. The apparatus of claim 8 wherein said strap, when in the free unattached state, has its legs bent toward each other at the connection with said base region at an angle less than 90°, said apparatus includes means for receiving said legs in parallel relation to thereby bend said base region into said bow.

10. The apparatus of claim 7 including at least three said straps in spaced relation parallel to the plane of said sheets and urged against the uppermost sheet of said stack.

11. The apparatus of claim 7 wherein said sheets of paper are fed to said copying portion in a given direction, said one strap being adjacent to the leading edge of said sheets in said stack.

12. A ground strap for grounding copy paper stored in and fed to an electrostatic copying machine comprising:

a spring metal member having a pair of legs connected to a base, the legs being bent toward each other at an angle less than 90° with respect to the base, said legs being adapted to be received by said machine adapted when in use to bend the legs sufficiently that the base bows toward and resiliently engages said fed paper.

13. In an electrostatic copying apparatus including stacking means for receiving and storing a stack of sheet paper to be fed to the copying portion of said apparatus, means for applying an electrical charge to the uppermost sheet of said stack, means for projecting an image of an object being copied onto said charged sheet, and means for developing the image on said charged sheet, and wherein each sheet is in surface contact with the preceding sheet in the stack as it is being removed from the stack, the improvement comprising:

at least one bowed spring metal conductor engaged with the uppermost sheet of the stack at the bowed portion thereof as that sheet is being removed from the stack, the convex portion of the bow facing and touching said sheet urging it against said stack, whereby said uppermost sheet being removed from the stack is in contact with said bowed portion as the sheet moves; and means electrically connecting said bowed conductor to ground.

* * * * *